US005371831A

United States Patent [19]

Gauer et al.

[11] Patent Number: 5,371,831

[45] Date of Patent: Dec. 6, 1994

[54] ELECTRICAL HEATING ELEMENT ASSEMBLY FOR WATER HEATER

[75] Inventors: Gary W. Gauer, Cottage Grove; Robert H. Sitko, Stillwater, both of Minn.

[73] Assignee: Water Heater Innovation, Inc., Eagan, Minn.

[21] Appl. No.: 958,018

[22] Filed: Oct. 7, 1992

[51] Int. Cl.[5] ..... F24H 1/20

[52] U.S. Cl. ..... 392/501; 392/455; 220/319; 220/254

[58] Field of Search ..... 392/501, 455; 219/523, 219/208; 220/254, 319, 582, 320

[56] References Cited

U.S. PATENT DOCUMENTS

| | | | |
|---|---|---|---|
| 2,008,156 | 7/1935 | Rottum | 220/319 |
| 2,725,252 | 11/1955 | Greer | 220/319 |
| 2,749,162 | 6/1956 | Humphrey | 220/319 |
| 3,695,482 | 10/1972 | Smith | 220/582 |
| 4,068,684 | 1/1978 | Greer | 138/30 |
| 4,463,871 | 8/1984 | Garbarini et al. | 220/582 |
| 4,765,507 | 8/1988 | Yavorksy et al. | 220/414 |
| 5,129,537 | 7/1992 | Bordner et al. | 220/321 |

FOREIGN PATENT DOCUMENTS

| | | | |
|---|---|---|---|
| 0491978 | 12/1976 | Australia | 392/501 |

*Primary Examiner*—Bruce A. Reynolds
*Assistant Examiner*—Gregory L. Mills
*Attorney, Agent, or Firm*—Moore & Hansen

[57] ABSTRACT

A port assembly for a non-metallic pressure vessel is joined to a boss which is molded into or otherwise joined to the vessel wall. A bayonet type accessory mount is insertable therein for sealing passage through the vessel wall. The mount includes a simple semicircular locking snap ring with easily manipulable handles. The locking snap ring is configured for retaining and locking an accessory such as a heating element in any desired rotational position within the port. An o-ring is sealingly compressed in a radial direction between the mount and the port assembly. A specific application includes the positioning of a non-linear electrical heating element within a non-metallic water heater.

21 Claims, 3 Drawing Sheets

ELECTRICAL HEATING ELEMENT ASSEMBLY FOR WATER HEATER

BACKGROUND OF THE INVENTION

1. Field of the Invention:

This invention relates generally to connection port assemblies for closed vessels. More particularly, this invention pertains to electrical heating elements and apparatus for inserting and retaining such elements in non-metallic pressure vessels.

2. Description of the Prior Art:

Electrical water heaters have been widely used in homes as well as in business places. Such water heaters comprise a metallic pressure vessel into which electrical heating elements are fixed. Typically, the pressure vessel has one or more flanged openings. The elements are fixed to a gasketed flange cover which is bolted to the flange on the pressure vessel. A leakproof seal requires that the elastomeric element between the flange cover and the vessel be highly compressed. Thus, the two are typically joined by multiple screws which are installed to provide the required high axial compression.

As is well known in the prior art, metal water heaters are susceptible to corrosion, and generally have a limited life.

The use of non-metallic materials such as plastics in the construction of water heaters has recently been established. In one exemplary water heater, the two-part vessel wall comprises an outer shell which overlays an inner liner. The shell is typically formed of a composite of a reinforcing fiber and a thermoset resin, and the liner may be formed of a thermoplastic material by blow molding or other method. The construction of ports for inlets, outlets, probes, heating elements, drains, etc. in non-metallic vessels is of special concern when the vessel is to contain liquids at elevated pressures and temperatures. Such is exemplified in the disclosure of U.S. Pat. No. 4,765,507 of Yavorsky et al. which teaches a tank port passing through a reinforcement insert .joined to the vessel wall between the shell and the liner. The fitting is swaged into a collar, and the port has internal screw threads for mounting threaded elements. The element is screwed into the port until an o-ring is sealingly compressed.

One disadvantage of such a threaded screw fitting is that elements requiring a particular rotative attitude in the port are difficult to install in the required position while simultaneously ensuring a positive seal against leakage.

In addition, salts in tile water typically become deposited on the thread surfaces, making subsequent removal of the element difficult. The high torque required to remove the threaded element necessitates extra strength to be built into the vessel wall.

BRIEF SUMMARY OF THE INVENTION

The primary object of this invention is to provide a vessel port which provides a tight seal at elevated temperatures and/or pressures.

Another object of this invention is to provide a vessel port which permits a probe, pipe fitting, or other accessory to be installed at a desired rotative attitude.

A further object of this invention is to provide a vessel port which permits installation/removal of an accessory quickly and with minimal or no tool use.

An additional object of the invention is to provide a sealable port for a non-metallic pressure vessel.

An additional object of this invention is to provide a vessel port which may be installed as a replacement part for an existing vessel port.

A further object of this invention is to provide a vessel port for inserting a non-symmetric heating element into the vessel whereby the element may be repeatedly and accurately installed in the desired rotative position in the port without being limited by the sealing requirements to a particular position.

Another object of the invention is to provide an improved electrical heating element for a water heater which results in more uniform water temperatures. The enhanced temperature uniformity enables more representative temperatures to be used for control.

These and other objects and advantages of the invention will be readily understood by reading the following description in conjunction with the accompanying figures of the drawings wherein like reference numerals have been applied to designate like elements throughout the various views.

BRIEF DESCRIPTION OF THE DRAWINGS

The invention will now be described in more detail with reference to various embodiments illustrated in the accompanying drawings, in which:

FIG. 3 is a cross-sectional side view of the accessory mounting apparatus as taken along line 3—3 of FIG. 2;

DESCRIPTION OF THE PREFERRED EMBODIMENTS

Figure 1:
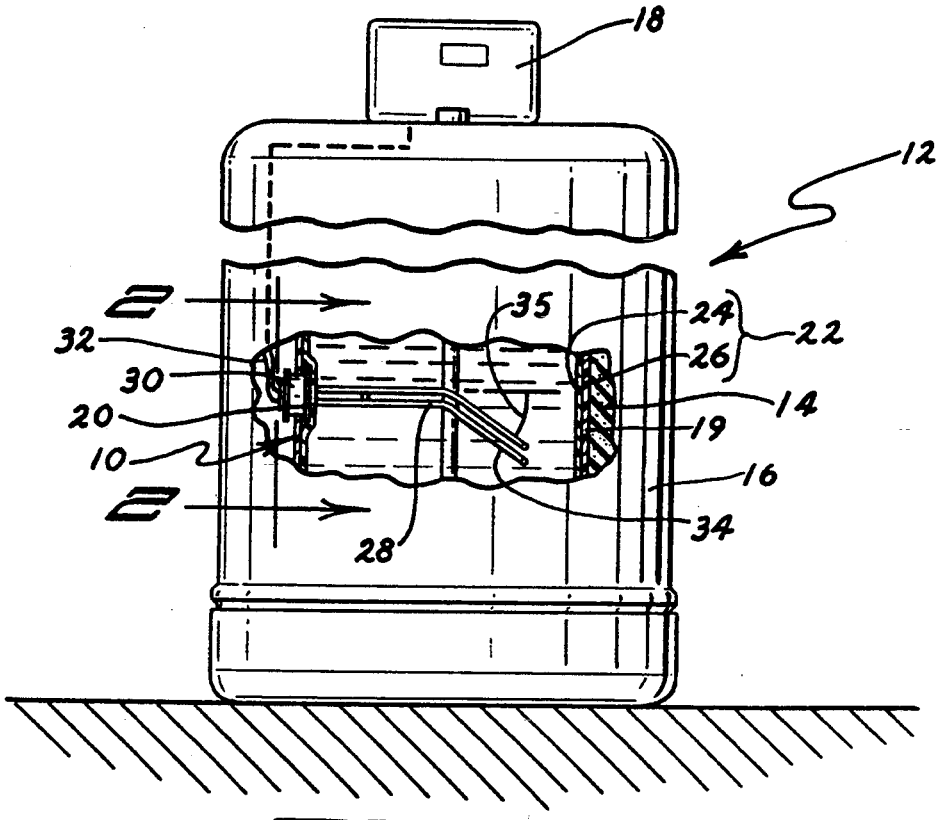
FIG. 1 is a partially cutaway side view of a heated pressure vessel with an accessory mounting apparatus in accordance with the invention.

With reference to the drawings, and particularly to FIG. 1, a vessel 10 is shown which is capable of containing a fluid at elevated temperatures and pressures. The vessel 10 is a tank for holding or treating gaseous or liquid fluids, and is illustrated as an upright cylindrical tank used as the inner chamber of an electrical water heater generally designated by the numeral 12. The water heater 12 is shown as including insulation 14 overcovering a major portion of the vessel 10, and an external skin or shell 16. A control unit 18 includes control function apparatus for operating the heater 12.

The vessel 10 as shown comprises a hollow container having an elongate cylindrical body portion 19 with hemispherical top and bottom. For the purposes of this invention, the vessel 10 may have any shape or configuration which requires a port or ports 20 for the introduction of fluids, sampling devices, sensors, heaters or other process devices or materials into the vessel 10.

The wall 22 of vessel 10 is shown as being a laminate formed of an inner layer or liner 24 and an outer layer or shell 26. The cylindrical portion 19 of the outer layer or shell 26 is typically oriented vertically and may be formed of fibers or other materials in a thermoset resin substrate, providing the necessary strength, rigidity and structural integrity at the elevated operating conditions. The inner layer or liner 24 is made of a material which is resistant to deterioration and leakage at the operating environment within the vessel 10. Thus, for example, a chemical resistant thermoplastic material such as polybutylene or polyurethane may be blow-molded or otherwise formed as the liner 24 of a water heater 12.

The insulation 14 overlying the wall 22 of water heater vessel 10 reduces heat losses and sound transmission from the vessel, provides support and enhances safety, and may comprise, for example, polyurethane foam. Outermost, external shell 16 may preferably be tough, impact resistant polyethylene.

In FIG. 1, an electrical heating element 28 with a bayonet type mount 30 is shown installed in a port 20 in the vessel wall 22 of a water heater vessel 10. Electrical power supply lines to the heating element 28 as well as temperature sensing/controlling means are together represented generally by line 32 extending to the control unit 18. For the sake of clarity, insulation 14, typically installed to surround the port 20, is not shown.

The number of heating elements 28 or other items introduced into the vessel 10 may vary. For example, while small water heaters may use a single heating element, larger heaters typically use two or more elements whereby a single element or several elements may be energized depending upon the particular usage rate of the heated liquid. Thus, a control system may energize one element during normal usage of hot water, and provide sequential, non-simultaneous energizing of both elements when faster heat recovery is required in the upper portion of the heater.

The heating element 28 is shown in the figure as having a distal portion 34 directed downwardly from the horizontal. The element 28 may be bent downwardly so that the downwardly directed portion comprises from about 30 to 75 percent of the heating element. The bent portion may vary from straight to curved, and preferably extends downwardly for at least about 7 cm. when installed in a heater vessel 10 of about 30 gallons or more. In one form, the heating element 28 has a portion directed downwardly at an angle 35 of about 10–60 degrees from the horizontal. The preferred angle 35 is between about 20 and 60 degrees and more preferably, between 20 and 45 degrees.

FIGS. 2 through 4 and FIG. 7 illustrate in more detail a first embodiment of the port 20 and a bayonet mount accessory 30 which may be sealably installed therein. It will be evident from the following description that the port 20 is easily installed in a vessel 10 and provides a strong leakproof entrance into the vessel which permits rapid and easy installation and lockable retention of a bayonet mount accessory 30 in any desired radial position. The accessory 30 is sealingly locked in the port 20 by a simple locking ring 40 without using tools, i.e. with simple finger manipulation, or with simple use of a needle nose pliers or the like. Screwing and unscrewing of threaded parts is avoided.

Figure 2:
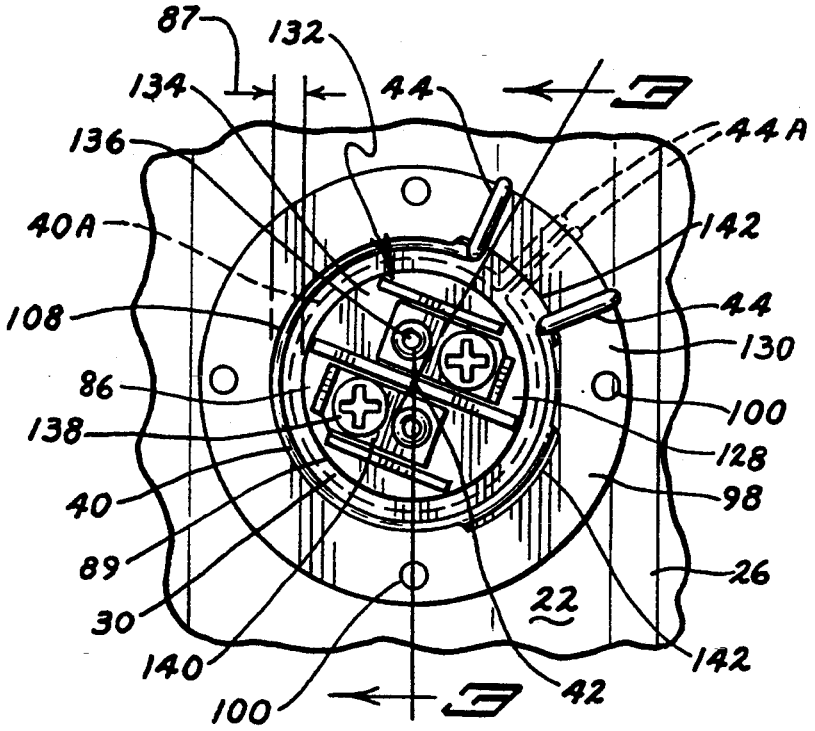
FIG. 2 is a front view of the accessory mounting apparatus as taken along line 2—2 of FIG. 1.
Figure 4:
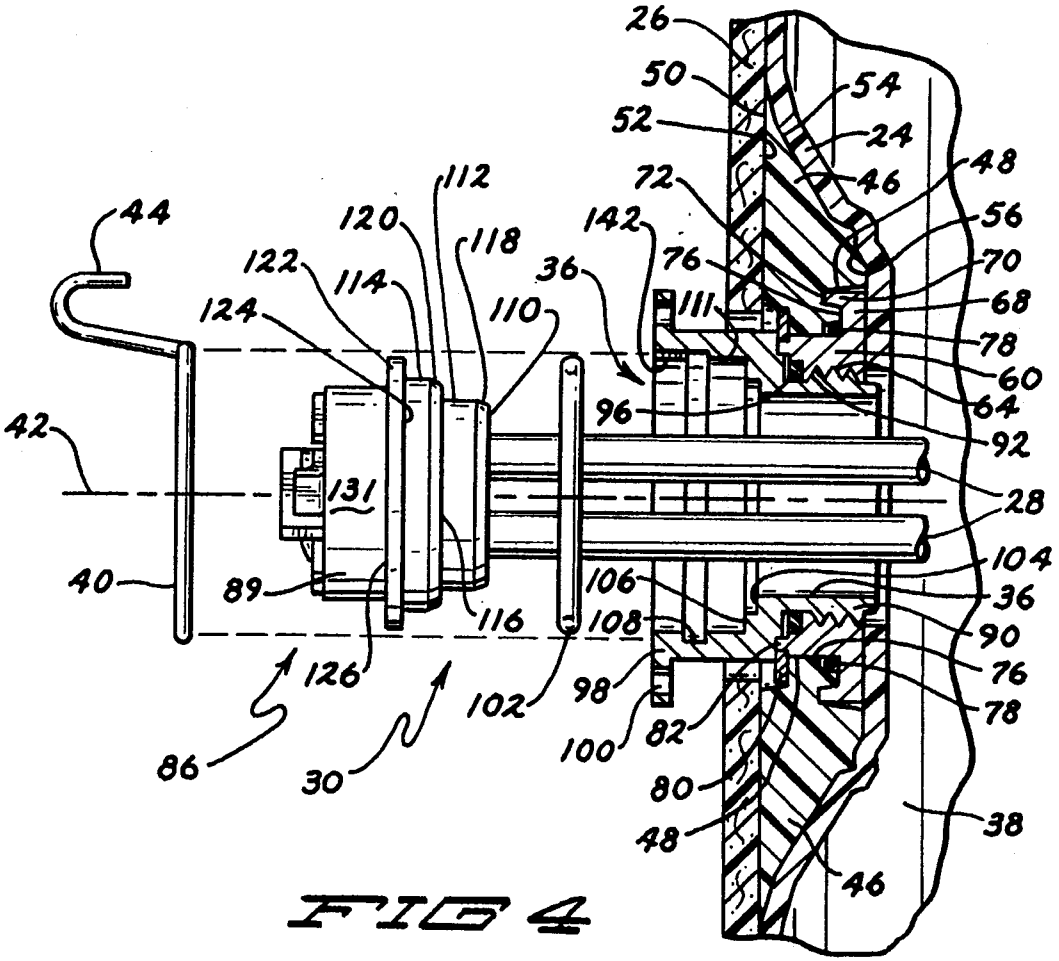
FIG. 4 is a cross-sectional side view of an accessory mounting apparatus of the invention with the accessory partially withdrawn.
Figure 9:
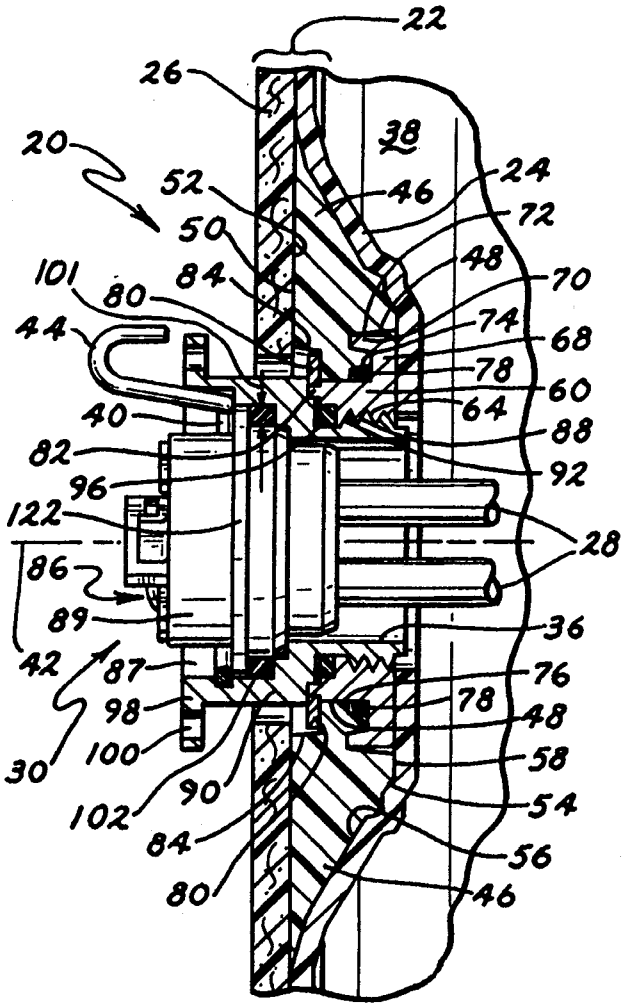

Turning now to FIGS. 2–4, the port 20 is shown as an assemblage of parts which surrounds a generally tubular opening 36 through wall 22 into the vessel interior 38. The opening 36 is generally elongate with central axis 42 and is adapted to receive an accessory 30 having a bayonet type mount.

As depicted in FIGS. 2 and 3, the port 20 is mounted in a boss 46 having a central opening 48 concentric about central axis 42. The port 20 is joined to the boss 46 within central opening 48. Boss 46 is shown with a first side or stirface 50 which conforms to and is sealingly joined to the inner wall 52 of shell 26, and an opposing, second side or stirface 54 which is adjacent to and conforms to the outer wall 56 of liner 24. The boss 46 may be formed of a thermoplastic or other polymeric material compatible with the liner 24 and shell 26. It must be sufficiently rigid to maintain the integrity and alignment of the port 20 in view of the various axial, radial and torsional forces which normally occur. The boss 46 lies intermediate the liner 24 and shell 26 of the bilaminar vessel 10, acting as a base for the port 20 and a reinforcing member. As known in the art, the liner 24 is preferably formed as by blow-molding to include a recess 58 into which the boss is fitted and bonded. The shell 26 is then formed over the liner 24 and boss 46. The shell 26 may be formed by filament winding with glass roving and polyester resin or the like.

The boss 46 may have any shape which carries the port assembly and which provides a surface for joining to the liner 24 with sufficient strength to maintain integrity.

If desired, the boss may be sealably joined to the inside of a monolayer vessel not constructed with a separate liner. This configuration is especially useful where stress-producing temperature changes are minimal.

The properties of the materials chosen for the liner 24 and the boss 46 joined thereto must be compatible so that changes in temperature and pressure do not create inordinate stresses in and between those members. Such large stresses may exceed the bond strength and cause separation and resulting leakage. Preferably, the boss 46 and liner 24 are formed of the same material such as the thermoplastic polybutylene.

As shown in FIGS. 2–4, the port 20 includes a cylindrical or annular collar member 60 which is fitted within central opening 48 in boss 46 and sealably attached to the boss. Collar member 60 is generally symmetrical about central axis 42. Collar member 60 includes a barrel portion 62 having screw threads 64 on its inner surface 66, and a radial flange 68 with a circumferential return flange 70. As viewed, these flanges are at the end of barrel portion 62 adjacent the vessel interior 38 and generally on the second side 54 of the boss 46. The return flange 70 is fitted into an annular slot 72 in the boss 46. The central opening 48 in boss 46 is configured to provide an annular recess 74 at the interface 76 between the collar member 60 and the boss 46. An elastomeric element such as an o-ring 78 is placed in the recess 74 for sealing the interface 76 against leakage.

The flange 68 or return flange 70 may be serrated, non-circular or otherwise so configured as to be held by the boss 46 in a non-rotatable position in opening 48.

Thus, the boss 46 abuts the flange 68 and return flange 70 to hold the collar member 60 against radial movement and against axial movement toward the exterior of the vessel 10.

To prevent axial movement of collar member 60 toward the vessel interior 38, a rigid retaining ring or washer 80. typically formed of metal, overlies the first side 50 of boss 46 and fits about an annular projection 82 at the end of the collar member 60 facing the vessel exterior. As shown in FIGS. 3 and 4, the washer 80 is seated in a washer recess 84 in the first side 50. The projection 82 is fixedly joined to the washer 80 by crimping or swaging the projection radially outward and over the washer 80.

The port 20 also includes a receiver 90 which is a generally cylindrical member with a stepped interior port opening 36 for receiving and sealably retaining a bayonet mount accessory 30.

A first external portion 92 of receiver 90 has external screw threads 88 which match the internal threads 64 of the collar member 60. A second external portion 94 comprises a radially disposed step which abuts the collar member 60 or retaining washer 80 when the receiver 90 is fully screwed into the collar member 60. A sealing element 96 such as an elastomeric washer or o-ring is mounted between the collar member 60 and the receiver 90 to prevent leakage at the interface between these two parts of the port assembly 20.

The outer terminus of receiver 90 is depicted as a flange 98 with radially spaced apertures 100 formed therein. Although the flange 98 enhances the rigidity of the receiver 90, it is not generally necessary to the invention.

The collar member 60 and receiver 90 may be formed of metal or other material such as fiber reinforced plastic. The material must be resistant to the environment within the vessel 10, and maintain sufficient rigidity and strength to avoid flexing, cracking and breakage under the applied forces.

As best shown in FIG. 4, the port opening 36 in receiver 90 is radially stepped for receiving a stepped bayonet mount accessory 30 such as the illustrated electrical heating element 28 with bayonet mount or base 86. The bayonet mount 86 fits snuggly in the port opening 36. A first internal portion 104 of the receiver 90 comprises a radially disposed step which acts as a stop to define the maximum insertion of mount 86. A second internal portion 106 is a radial step for retaining a sealing element 102 such as an elastomeric o-ring between the receiver 90 and the mount 86. The space between the receiver 90 and mount 86 into which the sealing o-ring 102 is fitted has a radial dimension 101 (see FIG. 3) which is smaller than the nominal cross-section dimension of the o-ring. Thus, the o-ring element 102 is radially compressed to an effective sealing relationship with the vessel.vessel 10 compresses the element 102 to an effective sealing relationship.

In addition, the receiver includes an exposed surface, preferably in the form of a radial recess 108 which is accessible from the vessel exterior and is configured for receiving a locking ring 40 to retain and lock the accessory 30 in the receiver 90.

For the purposes of this discussion, the accessory 30 is deemed to include (a) the bayonet mount 86 together with (b) the particular desired element, e.g. heating element 28, which is to enter or communicate with the vessel interior 38, (c) the sealing element 102 and (d) the locking ring 40. The bayonet mount 86 is a push-insertable element which requires no threaded rotation, either of itself or another locking member, to hold it in place in the receiver 90. The bayonet mount 86 is simply pushed into the receiver 90 and the locking ring 40 snapped into radially directed recess 108 to sealably lock the mount 86 in place.

The bayonet mount 86 is shown as a piston-like element with circular cross-section relative to central axis 42. Starting at the insertable end 110 of the mount 86, a first section 112 is adapted for insertion into port opening 36. A second section 114 of greater diameter has an annular shoulder surface 116 which is adapted to become seated on second internal portion 104 when the mount 86 is fully inserted. The edges 118 and 120 of first and second sections, 112 and 114, respectively, are preferably bevelled or radiused as shown to enhance insertion into the receiver 90. A third section 122 of mount 86 comprises a radially extending ring having an annular shoulder surface 124 which abuts and retains o-ring 102 against internal portion 106 when the mount 86 is fully seated. The o-ring 102 is squeezed radially between surface 114 and the inside diameter 111 of receiver 90. The sealing squeeze is maintained by the radial clearance 101 and not by axial forces on the retaining ring 40. The squeezing or compression forces are overcome during insertion before the mount 86 is fully seated. The retaining clip, i.e. locking ring 40 is easily installed because the resisting sealing forces are radial rather than axial. The opposite, outwardly facing surface 126 of the third section 122 is configured to abut and be held in place by the locking ring 40 which is expandingly snapped by spring action into radial recess 108.

Figure 7:
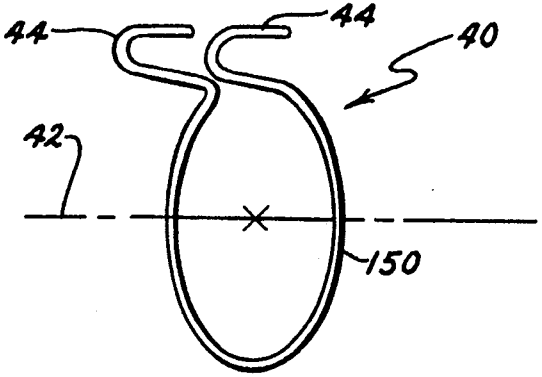
FIG. 7 is a perspective view of the lock ring of the accessory mounting apparatus of the invention.

The locking ring 40 is shown in more detail in FIG. 7, and is depicted as including a semicircular ring portion 150 with a handle 44 at each end. The ring 40 is preferably formed of spring metal which permits the handles 44 to be manually compressed together to reduce the ring diameter for insertion and retraction of the ring 40 from the radial recess 108. When fully seated in the recess 108, the semicircular portion 150 encompasses about 70 to 95 percent of a full circle, i.e. about 250–342 degrees. Removal of the ring 40 from the recess 108 requires the radius of the semicircular portion 150 to be reduced by about 5–30 percent, preferably in the range of 5–15 percent. Thus, a ring 40 having a seated diameter of 2 inches will require its handles 44 to be compressed a total of about 0.3 to 1.6 inches for insertion and removal. Of course, the handle spacing must be increased for ports having a greater diameter, in order to attain the necessary diameter change of the locking ring.

The locking ring 40 may also be used as a tool for removing an element or mount 86 from a water heater. A curved handle 44 may be placed about a loosened screw 138 (see FIG. 2) and pulled axially to remove the element. Alternatively, a through hole may be formed in a protruding portion of the mount 86, and a handle end of the ring 40 inserted through the hole and retracted.

Turning now to FIG. 2, in which the exposed face 128 of the bayonet mount 86 and the exposed side 130 of receiver flange 98 are shown, the bayonet mount accessory 30 is depicted as the electrical terminal assembly 132 of an electrical heating element. Assembly 132 is shown as including an electrically nonconductive member 134 which encases the end portions of the heating element and insulatingly seals the assembly 132 from the metallic exterior of mount 86, and from the vessel interior 38 (FIG. 1). The ends 136 of the element 28 (FIG. 1) are each connected to corresponding terminal screws 138 by conducting connecting members 140. Electrical supply lines 32 from a control unit 18, as shown in FIG. 1, are connected to the screws 138 for powering the heating element 28. The mount 86 may be substantially hollow, or have multiple bores therethrough, or have any configuration which satisfies the mounting requirements of the particular accessory 30. While the mount is shown here as formed of metal such as brass, steel or stainless steel, it may alternatively be formed of a plastic, plastic-fiber composite or other material which meets the requirements of use.

Returning to FIG. 2, locking ring 40 with non-compressed handles 44 is shown as lying partially within radial recess 108 in the expanded,locked position. The handles 44 may be manually circumferentially compressed together to an "open" position 44A. Such compression with the fingers reduces the circumference and diameter of the ring designated 40A in the compressed "open" position. The locking ring 40A is released from the radial recess 108 and may be simply lifted from the bayonet mount 86 in the annular space 87 between the receiver 90 and the exterior terminal portion 89 of mount 86. The locking ring 40 is installed by reversing the order of the above indicated steps.

The locking operation of locking ring 40 results from the combination of spring tension of the ring and the outward force of the vessel pressure upon the mount 86. The locking ring 40 is seated in radial recess 108, being biased by its spring tension to expand into the recess. The depth of recess 108 exceeds the ring cross-sectional radius so that at least one half of the ring cross-sectional area lies within the recess 108. As a result, removal of the locking ring 40 is extremely difficult while the vessel is pressurized.

As shown in FIG. 2, a portion or portions 142 of recess 108 are cut out for the handles 44 to project outwardly therethrough. These cutout portions 142 each encompass an angle sufficient to permit handle projection in the expanded "locked" position.

The locking and sealing apparatus described above occupy a narrow annular ring of space in and adjacent the receiver 90, leaving an extensive circular opening for the accessory 30 and integral mount 86 to be inserted into the vessel 10.

Figure 6:
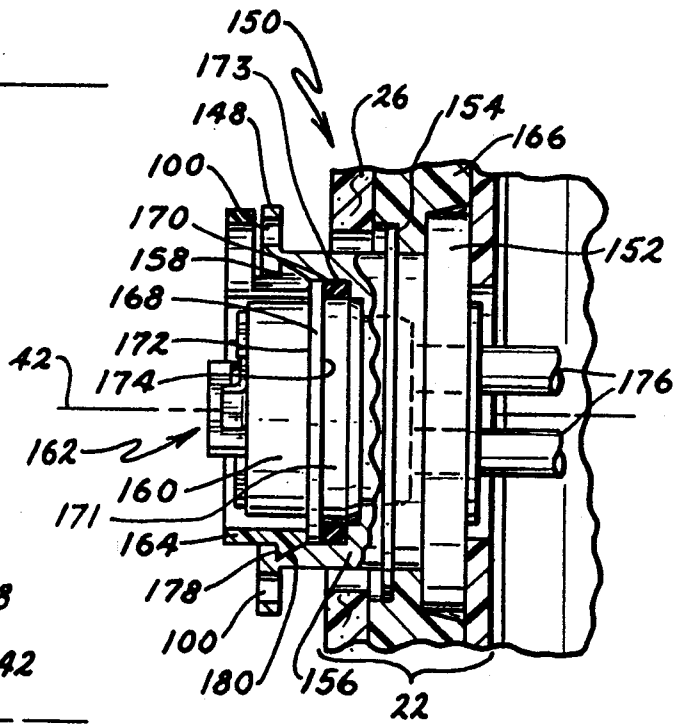
FIG. 6 is a cross-sectional side view of the accessory mounting apparatus of the invention as taken along line 6—6 of FIG. 5.
Figure 8:
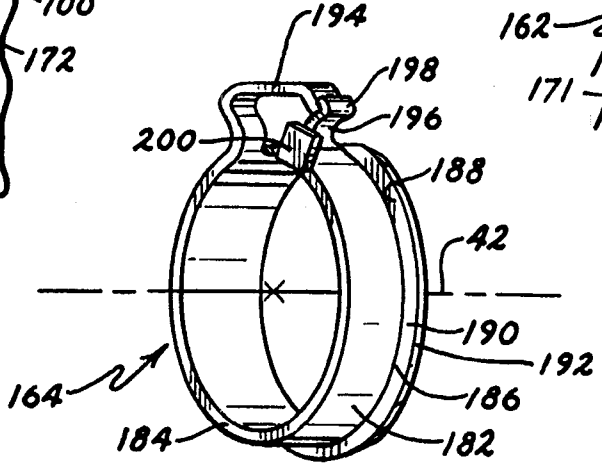
FIG. 8 is a perspective view of another embodiment of the lock ring of the accessory mounting apparatus of the invention.
Figure 5:
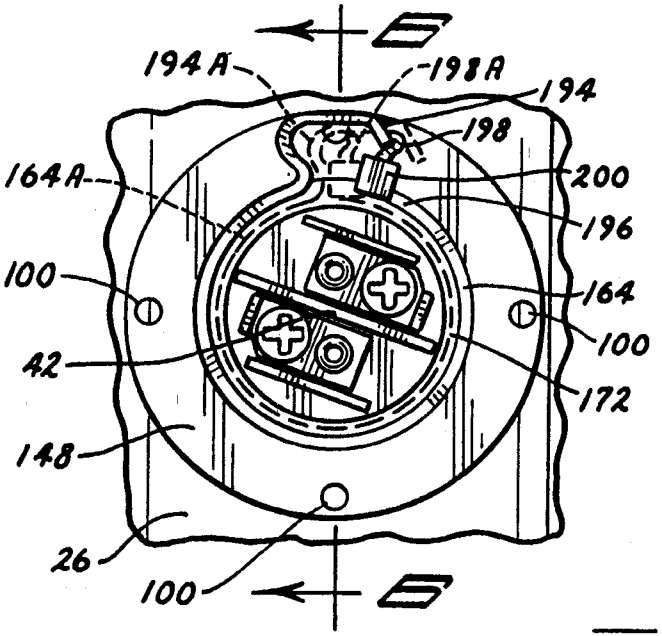
FIG. 5 is a front view of another embodiment of the accessory mounting apparatus of the invention.

Another embodiment of the invention is shown in FIGS. 5, 6, and 8. The port 150, including boss 166, collar member 152, retaining washer 154 and receiver 156, is mounted in vessel wall 22 as previously described. The port 150 differs from the prior embodiment only with respect to the radial recess 158 in the receiver 156, and to the bayonet mount 160 and locking ring which fit in the port.

Like the bayonet mount 86 of FIGS. 2, 3, and 4, the bayonet mount 160 of accessory 162 is shown as holding a heating element assembly designated 176 in this embodiment. Likewise, the receiver 156 terminates in a flange 148. However, bayonet mount 160 is configured to be locked in place using a resilient locking ring 164 of a different configuration. Similar to the construction of bayonet mount 86, the bayonet mount 160 includes a circumferentially extensive ring 168 having an inner side 174 which abuts and retains o-ring 170. The o-ring 170 is radially compressed between surfaces 171 and 173 to provide the desired sealing. Without pressure in the vessel, the axial resistance of the o-ring 170 is very small, so that installation or removal of the locking ring 164 is accomplished easily. On the other hand, when the tank is pressurized, the o-ring is compressed axially and provides a high resistance to removal of the locking ring 164.

The opposing, outer side 172 of ring 168 is configured to be held in the receiver 156 by the locking ring 164.

The latter locking ring 164 is shown in more detail in FIG. 8 as a unitary member. The locking ring 164 includes a semicircular tubular body 182 having a central axis 42 and extending in an axial direction between a front edge 184 and a rear edge 186. The rear edge 186 terminates in a radially extending flange 188 having a flat front side 190 lying in a plane perpendicular to axis 42. Although the opposite, rear side 192 may be likewise perpendicular to axis 42, or of another shape or stirface structure, it is shown in a preferred configuration, i.e. beveled to ease axial insertion of the locking ring 164 into the receiver 156.

The tubular body 182 of locking ring 164 has a first end 194 configured to be lockably retained by the second end 196. The two ends 194, 196 comprise handles by which the ring 164 may be inserted into and removed from the recess 158.

The second end 196 extends radially outward from the body 182 to a greater radius than the body 182, and has a recurved end 198 comprising a latch seat, i.e. a detent.

The first end 194 also extends radially outward to a greater radius and recurves toward the second end 196 as a movable resilient latch for engagement by the latch seat 198. The terminal portion 197 of second end 196 is curved radially inward to intersect the latch seat 198. When engaged, the two ends 194, 196 hold the flange 188 of locking ring 164 in a diameter which retains the flange 188 within the radial recess 158. The recurve configuration of the first and second ends 194, 196 allows them to be bent for repeated joining and separation. To install the locking ring 164, the movable latch 194 and latch seat 198 are separated and the latch seat moved under the latch. The latch 194 and latch seat 198 are then compressed circumferentially and the ring 164 inserted into the receiver 156 whereby the locking flange 188 becomes seated in the radial recess 158. The movable latch 194 is then snapped radially into the latch seat 198 to lock the accessory 162 in place. Alternatively, a tool may be used to move the latch 194 axially outward relative to the seat 198, and then sliding it into the seat.

To remove the accessory 162 from the receiver 156, locking ring or snap clip 164 is first unlocked by disengaging the movable latch 194 from the latch seat 198 by stretching the latch 194 away from the seat 198 to release it. A grip pad 200 on the front edge 184 of the ring 164 provides a convenient gripping location for a finger or pliers. The seat 198 is squeezed inwardly to force it under the latch 194. Circumferential compression of latch and seat reduces the diameter of the ring 164, releasing it from the radial recess 158. A tool such as a needle nosed pliers may be used to pull the ring 164 from the receiver 156. Although the installation and removal of locking ring 164 may be accomplished without tools, i.e. simply with finger manipulation, the ring may be formed with a high opening force, thus requiring a tool for installation and removal. As shown, the two ends 194, 196 may be separated by merely snapping the first end 194 outwardly past the second end 196.

It should be noted that the widths of the two ends 194, 196 are not equal to the axial width of the body 182, but comprise a portion thereof. This permits the two ends to project entirely outside of the receiver 156 to avoid the necessity for any cutout portion in the radial recess 158. Thus, the recess 158 may completely circle the receiver 156 without any discontinuity. The position of the handles 194, 196 is not limited to the location of cutout portions as in the embodiment of FIG. 2, but they may be located at any convenient portion of the complete circle.

The radial recess 158 may have a cross-section which is rectangular, circular or of other shape into which the locking ring 164 will fit. As depicted in FIG. 6, the recess 158 preferably includes a front side 178 lying in a plane perpendicular to central axis 42, and a rear side 180 which is beveled to match the beveled side 192 of the locking ring 164. The recess 158 preferably extends completely around the receiver 156, and unlike recess 108 in FIGS. 3 and 4, requires no cutout portion for accommodating the locking ring handles 44. The entire surface of side 188 is thus supportive of the mount 160 in the receiver 156.

The locking ring 164 may be formed of a spring metal or other resilient material. Preferably, the ring is formed of a plastic material such as nylon, etc.

As depicted in FIG. 5, the first and second ends 194, 196 may be disengaged and pushed or compressed together in a circumferential direction, the first end or movable latch 194 overlying the latch seat 198. As shown in this position, the first and second ends, designated 194A and 196A, respectively, reduce the diameter of ring 164, now designated 164A, whereby the ring 164A becomes disengaged from the recess 158 and may be lifted from the receiver 156. The bayonet mount 160 is then free to be removed by simply pulling it from the receiver 156.

The port of this invention permits the insertion and removal of accessories into pressure vessels easily and quickly. No threaded rotation is necessary to mount an accessory. The accessories are configured with bayonet type mounts which are simply pushed into the receiver and locked by insertion of a special snap ring. The accessory may be mounted in any desired rotational position, and is sealed by an easily replaceable o-ring.

To obtain uniform temperatures in water heaters, the contents must be vertically and horizontally mixed during the heating cycle. The use of a simple horizontal heating element tends to result in stratification of hot and cold water in portions of the vessel interior because the water is heated in narrow horizontal bands. On the other hand, the use of a vertical heating element results in high coalescence of hot water in a rising column about the element. The heating takes place across a reduced temperature difference, so localized underheating and overheating may occur.

As shown in FIG. 1, a heating element 28 which has an angular portion extending over a vertical range produces a hybrid result, increasing the overall mixing without significantly increasing localized overheating and/or underheating. In addition, the use of such an angular element as the lower element in a heater results in substantial improvement in heating of the lower portion of the vessel 10. The enhanced temperature uniformity makes temperature measurement more accurate, resulting in a narrower temperature control. In the preferred form the downwardly directed portion 34 of the heating element 28 comprises 30 to 75 percent of the heating area of the element 28 and may be directed downwardly at an angle 35 of 10–60 degrees from the horizontal. The preferred angle is between about 15 and 45 degrees. A dual element electrical water heater 12 of 30–60 gallons capacity may have a lower heating element in which the angled portion extends downwardly for at least about 7 cm. vertical displacement It is anticipated that various changes and modifications may be made in the construction, arrangement, operation and method of construction of the apparatus disclosed herein without departing from the spirit and scope of the invention as defined in the following claims.

What is claimed is:

1. A port assembly for sealably mounting an accessory with a bayonet base through a wall of a water heater pressure vessel, comprising:

a generally annular receiver with a central axis and having a circular opening therethrough with a stepped surface, said stepped surface including:

a first step having a surface for seating the bayonet base in the receiver; and a radially directed recess for lockable insertion therein of a locking ring;

a removable bayonet base for mounting an accessory in said receiver, said bayonet base having an outer stepped surface including an annular shoulder surface seatingly engaging said surface of said first step; and a radially expandable locking ring externally removably insertable in said recess and abutting said bayonet base to restrainably, sealably lock said bayonet base in the receiver.

2. The port assembly of claim 1 wherein:

said receiver stepped surface further comprises a second step on which an elastomeric sealing member is seated between the receiver and the bayonet base, and the bayonet base further comprises a second annular shoulder surface beating against the sealing member.

3. The port of claim 2, wherein:

said sealing member is radially sealably compressed between the receiver and the bayonet base when said bayonet base is inserted in said receiver.

4. The port assembly of claim 1 wherein said recess is circular with an axial depth and said locking ring comprises:

a semicircular resilient member configured for insertion into said recess, said semicircular member having circumferentially spaced opposite ends; and a pair of handles, each said handle projecting from one of said opposite ends for manual access thereto, said pair of handles configured for mutual circumferential compression to reduce the diameter of said semicircular member for insertion or removal from said recess.

5. The port assembly of claim 4 wherein:

said semicircular member joining said handles encompasses 290 to 335 degrees about said circular recess.

6. The port assembly of claim 4, wherein:

a portion of said receiver overlying the circular recess is partially cut away for accommodating said handles of said locking ring when said ring is inserted therein.

7. The port assembly of claim 4 wherein:

said locking ring is formed of a single piece of spring wire bearing against said recess and abutting said bayonet base to lock the accessory mounting bayonet base in the receiver.

8. The port assembly of claim 7 wherein:

the axial depth of said recess is substantially equal to or greater than the cross-sectional radius of said spring wire.

9. The port assembly of claim 1, wherein:

said recess is circular and said locking ring comprises:

a semicircular member of resilient material, said member having a substantially flat front face portion and a rear face generally parallel thereto, wherein said front face is configured to abut an inside face of said recess and a portion of said rear face is configured to abut said bayonet base, said member having a greater and a lesser diameter;

a semicircular barrel portion extending axially outward from the lesser diameter of said semicircular member, said barrel portion having opposing ends; and handles distally mounted on said opposing ends and configured for manual circumferential compression to insert or remove said locking ring from said recess.

10. The port assembly of claim 9, wherein:

said rear face is bevel led on the outer circumference thereof for facilitating insertion into said receiver recess.

11. The port assembly of claim 9, wherein:

said handles are interlockable to require forced radial separation and subsequent circumferential compression for reducing the greater diameter thereof to remove said locking ring from said recess.

12. The port assembly of claim 11, wherein:

one of said handles includes a portion comprising a latch seat, and the other of said handles includes a movable latch extending to said latch seat and engageable therewith to lock said handles in spaced-apart configuration whereby said lock ring is locked in said recess for sealable retention of said bayonet base in said port assembly.

13. The port assembly of claim 9, wherein:

said locking ring comprises a unitary construction of plastic material.

14. The port assembly of claim 1, wherein:

said receiver is formed of a material having one of an iron, copper, aluminum and magnesium base metal.

15. The port assembly of claim 1 further comprising:

an accessory comprising a heating element for an electric water heater, and said heating element comprising an elongate electrically conductive, heat emitting element mounted in and projecting generally horizontally from the bayonet base through the circular opening of the receiver.

16. The port assembly of claim 1 further comprising:

an accessory comprising a heating element comprised of a first, proximal segment projecting generally horizontally from said bayonet base when the base is mounted in the receiver and a second, distal segment projecting angularly from said first segment, and the second segment being directed downwardly when the port assembly is installed in the wall of said water heater.

17. A port assembly for mounting a bayonet base accessory through a wall of a non-metallic water heater pressure vessel, comprising:

a non-metallic rigid impervious boss having a first side conformable to a vessel wall and having a generally central circular opening passing from the first side to an opposite side thereof, said central opening having a central axis;

an annular collar member comprising:

a barrel portion coaxial with said central axis, said collar member having an external surface mounted in said central opening and a threaded internal surface;

an end flange configured to abut said first side;

a return flange extending from said end flange into an annular slot in said first side of said boss for attachment thereto: and means configured to abut said opposite side for locking said collar member to said boss;

a tubular receiver coaxial with said central axis for receiving and lockingly engaging a rotatable bayonet mount accessory therein at an axial insertion distance, said receiver having a first end proximate said vessel exterior and a second end proximate said vessel interior, said tubular receiver having an outer surface with screw threads for attachment to said threaded internal surface of said collar member and having a stepped inner surface including an accessory step comprising a stop for limiting tile axial insertion distance of said accessory by abutment thereto, a circular o-ring step for retaining a sealing o-ring, and a circular, radially directed recess for removable insertion of a circumferentially compressible locking ring; and a locking ring within said circular recess and restrainably abutting said accessory.

18. The port assembly of claim 17 further comprising:

a locking ring, wherein said locking ring comprises a semicircular member of spring wire having two ends and a central axis coinciding with the central axis of said boss, each said end projecting from said semicircular portion in a direction generally parallel to the central axis of said member to form a handle, wherein said member normally lockingly fits within said circular recess and is reduced to a lesser diameter circle by mutual compression of said handles for insertion and removal of said locking ring from said circular recess.

19. The port assembly of claim 17, wherein:

said o-ring is sealingly compressed in a radial direction between said receiver and said bayonet mount.

20. A port assembly for mounting an accessory having a bayonet base through a non-metallic wall of a pressure vessel, comprising:

a non-metallic boss having a first side conformably joinable to a vessel wall and having a generally central circular opening passing from said first side to an opposite side thereof, said opening having a central axis:

an annular collar member including a barrel portion having internal screw threads, said collar member engagingly joined to said boss at the opposite side thereof;

a bayonet receiver having external screw threads threadedly attached to the internal screw threads of said collar member, said receiver having a stepped circular axial opening therethrough including seat means for abutting reception of a bayonet base of an accessory, and a radially directed recess located axially outwardly from said seat means along said central axis and adapted to accept a circumferentially compressible locking ring removably insertable therein; and a locking ring within said radially directed recess and restrainably abutting said bayonet base.

21. The port assembly of claim 20 and further comprising:

a step on said bayonet receiver on which an elastomeric o-ring is seated, the bayonet base being removably insenable in the receiver in containing contact with the o-ring and the o-ring sealably compressible in a radial direction between the bayonet base and the receiver.

* * * * *